United States Patent [19]

Säufferer et al.

[11] 4,082,070

[45] Apr. 4, 1978

[54] INSTALLATION FOR FEEDING AND ATOMIZING LIQUID, ESPECIALLY COMBUSTION FUEL

[75] Inventors: Helmut Säufferer, Esslingen; Karl Willmann, Aichwald, both of Germany

[73] Assignee: Daimler-Benz Aktiengesellschaft, Stuttgart, Germany

[21] Appl. No.: 623,051

[22] Filed: Oct. 16, 1975

[30] Foreign Application Priority Data

Oct. 19, 1974 Germany ..... 2449848

[51] Int. Cl.[2] ..... F02B 33/00

[52] U.S. Cl. ..... 123/119 E; 60/39.82 S; 239/533.3; 239/536; 239/15; 261/118; 261/DIG. 39

[58] Field of Search ..... 123/119 E; 239/533.2, 239/533.3, 536, 15; 60/825

[56] References Cited

U.S. PATENT DOCUMENTS

| | | | |
|---|---|---|---|
| 1,360,654 | 11/1920 | Littlefield | 123/119 E |
| 2,493,073 | 1/1950 | Kinneen | 60/39.82 S |
| 3,266,783 | 8/1966 | Knight | 123/119 E |
| 3,361,353 | 1/1968 | Millman | 123/119 E |
| 3,761,062 | 9/1973 | King | 123/119 E |
| 3,825,239 | 7/1974 | Rice | 123/119 E |
| 3,960,693 | 6/1976 | Weyl | 123/119 E |
| 3,989,017 | 11/1976 | Reece | 123/119 E |

*Primary Examiner*—Charles J. Myhre
*Assistant Examiner*—Jeffrey L. Yates
*Attorney, Agent, or Firm*—Craig & Antonelli

[57] ABSTRACT

Apparatus for the conveyance and atomization of a liquid including at least one nozzle directed toward an atomizing chamber, a pressure source or reservoir providing a conveying pressure for the liquid, a fluid-dynamic connection connecting the nozzle and the pressure source or reservoir, and an electrode disposed a predetermined distance in front of the nozzle. At least a portion of the nozzle is formed of an electrically conductive material and is electrically insulated at least with respect to the electrode. A difference in potential is applied between the electrically conductive portion of the nozzle and the electrode during an atomizing period, whereby liquid discharged from the nozzle is atomized.

40 Claims, 3 Drawing Figures

FIG. 2
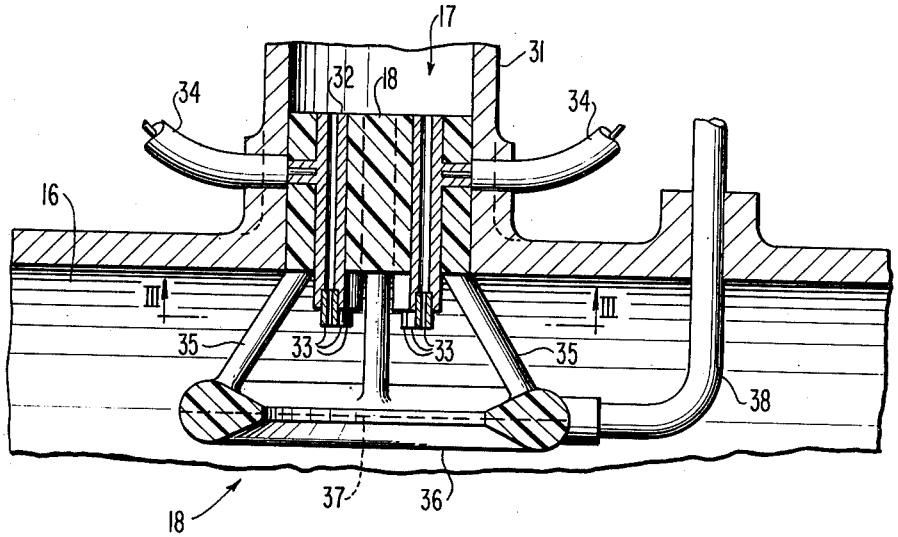
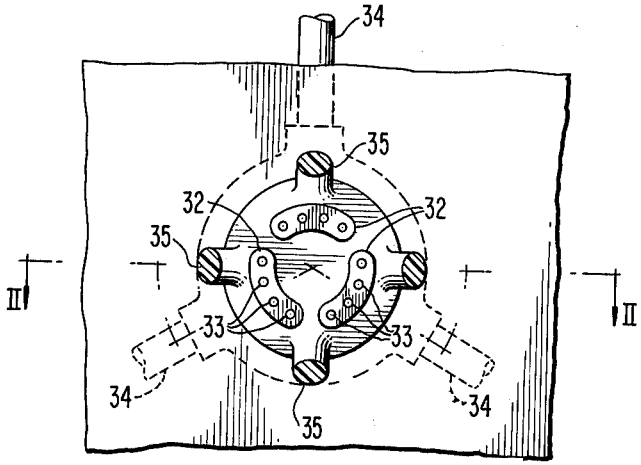
FIG. 3

INSTALLATION FOR FEEDING AND ATOMIZING LIQUID, ESPECIALLY COMBUSTION FUEL

The present invention relates to an apparatus for the conveyance and atomization of a liquid with at least one nozzle directed toward an atomizing chamber, with a pressure source or pressure reservoir providing a conveying pressure for the liquid, and with a fluid-dynamic conduit connection between the nozzle or nozzles and the pressure source or pressure reservoir.

Atomization problems must be contended with in technical fields in a great variety of ways, for example during air humidification, either for air-conditioning a living or working space or for conditioning the processing air for various kinds of process operations. However, atomization problems are also encountered, in particular, during the combustion of liquids, for example, in furnace plants or in internal combustion engines, be they gas turbines, rotary piston engines, or reciprocating piston engines.

Atomizing devices of the above-described type are based on the principle of dividing the liquid into small droplets by means of aerodynamic forces, either by moving the medium, into which the atomization is to take place, at high speed past an atomizing nozzle, or by injecting a thin jet of liquid with high relative velocity into such a medium. In any event, a certain amount of power must be expended which, however, in some cases is required anyway for other reasons; for example, in case of the Venturi carburetor of an internal combustion engine, a certain air acceleration during the intake of the air is absolutely necessary. The atomizing quality, i.e., the fineness of the droplets, can, however, be dependent in such cases of application on the air velocity, i.e., it can be indirectly predetermined by the operating conditions.

It is therefore an object of this invention to improve an apparatus of the aforementioned type so that the power expended for the atomization is reduced and that likewise a simplification of the construction of the apparatus is attained in correspondence with the smaller amounts of power input.

This object is obtained, in accordance with the invention, by arranging a preferably flow-permeable electrode at a predetermined distance from the at least one nozzle, by making the nozzle proper, in a conventional manner, of an electrically conductive material with the nozzle being electrically insulated at least with respect to the electrode, and by applying a difference in electric potential during the atomizing period between the at least one nozzle and the electrode.

On the basis of this invention, a different atomizing principle is being employed, namely electrostatic liquid atomization or nebulization. By the application of a high electrostatic field, the surface tension of the liquid appearing at the atomizing nozzle is not only overcome with respect to its effect, but also homopolar electric charge forces are imparted to the liquid particles which scatter the liquid particles from a close-knit body of liquid and nebulize these particles into many small, individual droplets. The separation into droplets continues until the surface tension of a small droplet predominates over the electrostatic separation forces and is capable of holding a closed liquid sphere together. The larger the electrostatic field in the zone of the atomizing nozzle, the finer the thus-produced droplets.

Basically, the atomization can be accomplished under back pressure or also without back pressure, so that it is also possible to effect an atomization in the combustion chamber of an internal combustion engine. In this connection, certain practical difficulties are merely encountered, residing in a safe mode of operation and in the operation of an atomizing nozzle which can be shut off, as it must be used in such a case, namely a so-called atomizing valve. In case of spark-ignition internal combustion engines or in case of internal combustion engines with a continuous combustion or also in case of furnace systems, however, the injection takes place in most cases into a chamber under low pressure, so that the use of an atomizing nozzle which is constantly open mechanically is possible without any operating problems, and the advantages of this invention can be fully exploited.

According to a feature of the present invention, an effective atomization and/or a prevention of a subsequent dripping of non-atomized liquid when the electrostatic field is inactivated is achieved by maintaining the conveying pressure for the fuel at such a low value that, although this pressure can, on the one hand, overcome the hydraulic resistances between the nozzles and the pressure source even in case of maximum amounts to be atomized per unit time, the surface tension of the liquid effective at the edge or end of the nozzle prevents, on the other hand, in case of identical electric potential between the nozzle and the electrode, a conveyance of liquid through the nozzle. The surface tensions of the liquid which are again fully effective at the orifice or orifices of the atomizing nozzles after the electrostatic field is inactivated seal off, so to speak, the nozzles at a minor initial pressure. This surface tension can withstand a pressure which is of a higher value in accordance with a decrease of the hydraulic radius of the open cross-sectional area of the nozzle or nozzles, in other words, the greater the number of individual nozzles into which a certain required cross-sectional area has been broken up. A high conveying pressure and accordingly a particularly small hydraulic diameter are required if it is necessary during an intermittent atomization to rapidly accelerate or decelerate the column of liquid to be atomized. The subdivision of a certain cross section into many small, individual nozzles is advantageous for still another reason. The size of an individual nozzle is — apart from the field strength applied — a governing constructional factor for the size of the thus-produced mist droplets. The smaller the outlet orifices, the finer can be the atomization at a predetermined potential difference between the nozzle and the electrode. However, a fine atomization is the basic prerequisite for a good, complete combustion, resulting in a high fuel utilization and clean exhaust gases.

To increase the density of the lines of force in the region of the atomizing nozzles and/or the individual nozzles of a group of nozzles effective in combination, according to another feature of the present invention, the edge of the nozzles is constructed maximally narrow with respect to the electrically conductive part and projects in the direction toward the electrode as compared to other electrically conductive areas in the immediate vicinity of the nozzle. Thereby, the effectiveness of the electrostatic field can be increased, at a predetermined difference in potential, and an even finer droplet separation can be achieved. By the pointed extension of the small nozzle edges, a field inhomogeneity is produced leading in the zone of the liquid level in the nozzle orifice to a drastic, excessively great local increase in the field. The extent of the potential difference of the field in the zone of the nozzle orifice is precisely the factor responsible for the droplet formation. Due to the excessively great local field increase, the potential difference applied in total between the nozzle and the electrode is in part concentrated at the site where it is required. The disadvantageous consequences of an excessively large potential difference between the nozzle and the electrode — namely possible sparkovers or strong attraction of the thus-formed mist droplets to the electrode — are eliminated right from the beginning, since in regard to this aspect a moderate difference in potential is merely necessary to achieve an adequate effect.

When using the atomizing device of this invention in internal combustion engines, it is advantageous to arrange the atomizer nozzle in the zone of the intake pipe at a location of normal flow cross section. In this case, it is unnecessary to provide a carburetor, and the atomizing device can operate continuously. In this instance, the difference in potential is maintained uninterruptedly during the operating period. The extent of the potential difference, i.e., the field strength, can readily be varied, for example by displacing a tap at a potentiometer, and the atomizing device can be controlled correspondingly. In this way, it is also possible to meet complicated control and/or operating conditions by electronic means. Of course, the atomizing device of this invention can be utilized simultaneously with a conventional atomizer, for example with a Venturi carburetor, or together with a conventional intake pipe injection system. Thereby, the Venturi carburetor can be of an essentially simpler structure and merely certain operating conditions must be taken into account, while other adaptation and control functions can be taken over by the electrostatic atomizing unit. In combination with intake pipe injection systems, it is possible to improve the atomization of the fuel especially in the partial-load range.

The nozzles of the atomizing device are to be arranged at a site where a flow exists, however, a high relative air flow is unnecessary. The flow around the nozzles and the electrode is to be sufficiently strong so that the forces effective aerodynamically on the thus-formed mist droplets are greater than the forces effective electrostatically thereon. The thus-produced mist droplets are charge carriers bearing the sign of the charge of the nozzles and are attracted by the electrode. When the surroundings are stagnant, or in case the surrounding flow is insufficient, the mist droplets would coagulate on the electrode which, of course, is to be prevented. Consequently, in case of an injection into the combustion chamber, the nozzles and the electrodes would have to be arranged, for example, in the zone of turbulent flow.

The electrostatic gasoline nebulization can also be carried out intermittently in the cycle of the internal combustion engine. Such a mode of operation is advantageous in case of intake pipe injection in the closer vicinity of the intake valve, or in case of a direct injection into the combustion chamber by way of an atomizing valve. The start of the injection and the duration of the injection can easily be controlled with auxiliary electronic means, since the only decisive factor is the application of a voltage at a specific instant.

To obtain an improved control of the quantities to be atomized over larger control ranges, it is advantageous to electrically insulate at least a single nozzle or a group of nozzles among the total number of nozzles with respect to the others, and to provide same with an electric connector, and it is furthermore suitable to provide means, preferably a switch, making it possible to selectively apply to the single nozzle or the one group of nozzles the electric potential of the other nozzles, independently of the potential difference of the other nozzles with respect to the electrode, or to electrically separate such one nozzle or one group of nozzles from the others.

These and further objects, features and advantages of the present invention will become more apparent from the following description when taken in connection with the accompanying drawings, and wherein:

FIG. 2 is an enlarged sectional view of the atomizing nozzles with the electrode arranged in front thereof; and FIG. 3 is a view of the atomizing nozzles taken along line III—III of FIG. 2.

Figure 1:
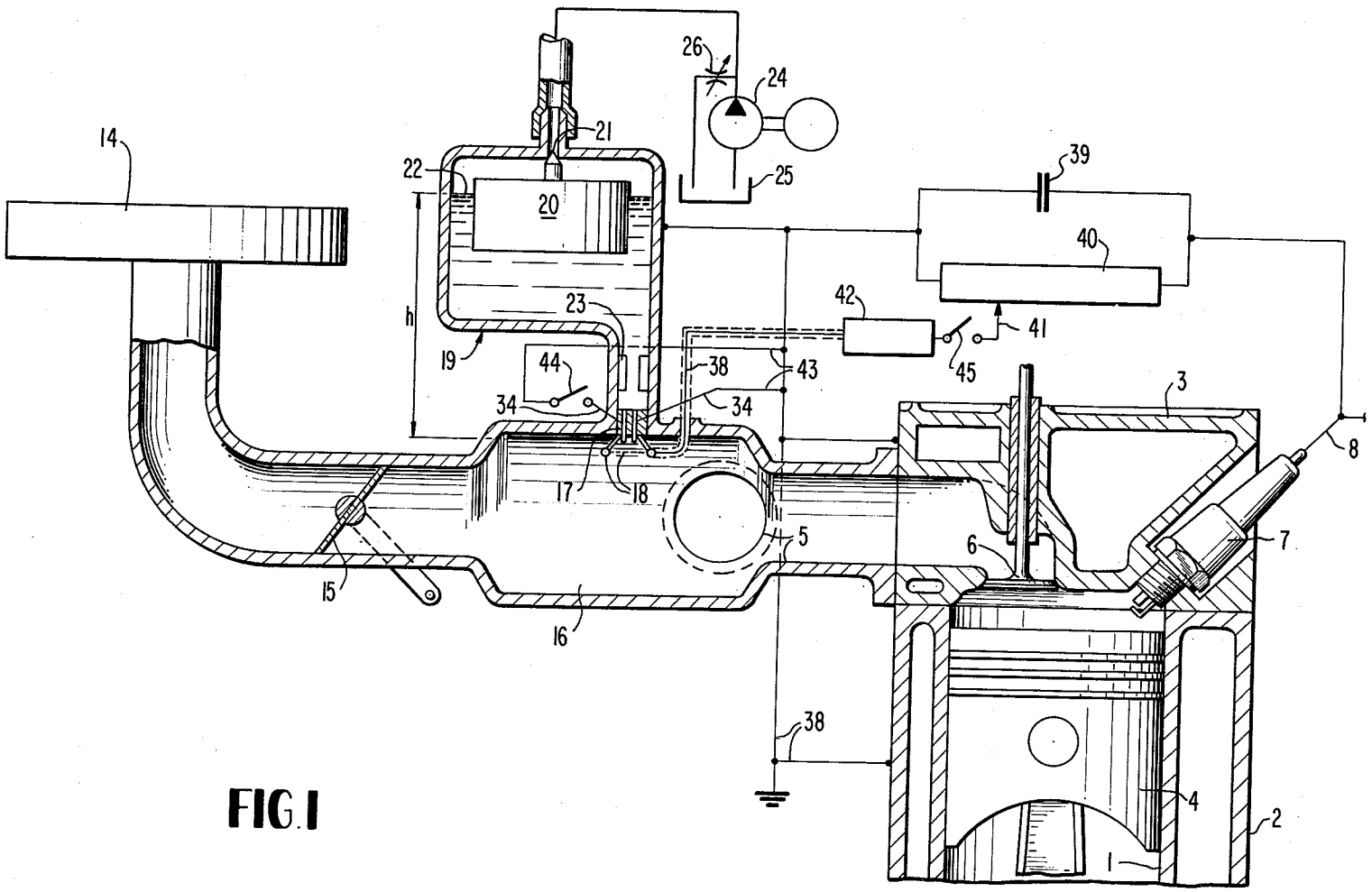
FIG. 1 shows the operating chamber of an internal combustion engine and an arrangement for producing the mixture in accordance with the present invention.

Referring now to the drawings wherein like reference numerals are utilized throughout to designate like parts, there is shown in FIG. 1 an internal combustion engine including an engine block 2 containing a cylinder working surface or liner 1 and a cylinder head 3. The piston 4 slides in the cylinder liner surface. The combustion chamber — as illustrated — is defined by the piston head of the piston, which is in the top dead center position, the cylinder liner 1, and the cylinder head bottom. During the intake stroke of the piston, air/fuel mixture passes through the intake manifold 5 and the open inlet valve 6 into the widening operating chamber. The ignition device, namely a spark plug 7, is arranged at some location of the combustion chamber. The ignition pulses are fed to the spark plug by way of the ignition cable 8 from the ignition unit of the engine, not shown.

The engine furthermore includes a mixture preparing device with an air intake filter 14, a throttle valve 15, an atomizing chamber 16, as well as an atomizing device of the present invention, denoted by 17, 18, 19 and including atomizing nozzles 17, an electrode 18 arranged at a predetermined or defined distance in front thereof, and a float chamber 19 serving as a volume and pressure reservoir. The quantity of the fuel can be controlled by means of the atomizing device 17, 18, 19, and the amount of air in the air-fuel mixture can be regulated by means of the throttle valve 15.

The float chamber 19 having a float 20, a float needle 21, a fuel level 22, and a feed nozzle 23 is arranged geodetically above the atomizing nozzle (difference in height $h$). The float chamber is constantly maintained at the filling level 22 by the fuel feed pump 24 taking in fuel from the storage tank 25. Excess amounts conveyed by the pump 24 flow back into the storage tank via the adjustable bypass throttle 26. By means of the float chamber with its filling level 22, a defined feeding level $h$ is always maintained above the atomizing nozzles 17 as a pressure reservoir and a volume storage means. The atomizing nozzle 17, which will be explained in greater detail below, is fashioned with respect to its open cross-sectional area and/or its distribution over several individual nozzles so that the surface tension of the surface of the liquid present at the atomizing nozzle is, in case of stagnating air in the atomizing chamber and with the electrostatic potential at the electrode 18 being inactivated, sufficiently large so that it can with certainty withstand the feeding pressure *h*. Thereby, an automatic fuel shutoff is achieved when the engine is at a standstill.

As can be seen from the enlarged, detailed views of the atomizing nozzles in FIGS. 2 and 3, the nozzle 17 has an insulating body 30 of a synthetic resin which is pressed, under pretensioning, sealingly into the feed pipe 31 from the float chamber into the atomizing chamber. In the illustrated embodiment, three nozzle groups 32, as shown in FIG. 3, consisting of respectively four individual nozzles 33 are embedded in the insulating body. The nozzle groups are made of an electrically conductive material and are provided with a terminal 34 leading to the outside. Due to the insulated arrangement of the nozzle groups and due to the terminals extended individually to the outside, the nozzle groups can individually be connected to a predetermined electrostatic potential, e.g., zero potential, or they can be separated from a predetermined potential. For this purpose, as shown in FIG. 1, a switch 44 is provided, which is illustrated as a representative example for the several groups of nozzles. The individual nozzles 33 of the nozzle groups project with their nozzle edge or discharge outlet with respect to the electrically conductive surroundings in the direction toward the electrode. This exposed position of the narrow nozzle edges in an electrical field being built up between the nozzle and the electrode leads to a field inhomogeneity and a strong concentration of the lines of flux, i.e., an increase in field strength in the zone of the nozzles which — as will be explained below — is very important.

A screen plate 37, as shown in FIG. 2, of an electrically conductive material is arranged so that it is insulated from and disposed at a defined distance from the nozzles. This screen plate is held by spacer arms 35 and a ring 36. By way of a connector 38 electrically conductively connected to the screen plate 37, the latter can be connected to a specific electrostatic potential. A switch 45, as shown in FIG. 1, makes it possible to apply or cut off the potential for brief periods of time. This switch can be a mechanical switch or also a non-contacting switch. The operation of the switch can be such that, depending on the design of the system as a continuous injection unit or as an intermittent injection unit effective in cycles, the switch is actuated either once or in cycles corresponding to the operating cycles of the engine.

A capacitor 39 of high capacitance and a high breakdown voltage is connected electrically in parallel to the spark gap of the spark plug 7 and serves as the voltage source for building up an electric field between the nozzle and the electrode and/or for imparting to the electrode a sufficiently high electric potential with respect to the nozzles. This capacitor is charged in surges by the ignition voltage and/or is maintained in the charged condition. The solid parts and the housing parts of the engine are connected to the same zero potential via ground lines 43 by being connected with one another and with the chassis and the body of the associated vehicle, not shown. A potentiometer 40 is connected electrically in parallel with the capacitor 39 with one end or terminal of the potentiometer being connected to zero potential. Thereby, varying potentials can be derived by means of taps from the potentiometer (sliding contact 41). The sliding contact 41 is connected by way of a current-limiting high-ohmic resistor 42 (e.g., 20 MΩ) to the connector 38 (shielding cable) of the electrode 18 of the atomizing device. The resistor 42 serves for preventing sparkovers from the nozzle to the electrode.

The mode of operation of the present invention is briefly as follows: By applying a high voltage to the electrode 18 (e.g., in the range of between 5 and 10 kilovolts) and by the exposed position of the nozzle edges in the electrostatic field, differences in field strength of a noticeable size are produced in the area of the exit zone of the nozzles. These differences in field strength in the zone of the liquid level introduce into the liquid separating forces which counteract the surface tension, resulting in a disintegration of the liquid into extremely small droplets. The surface tension is limited with respect to its cohesive effect to very much smaller surfaces and/or liquid particles and is no longer capable of spanning the free nozzle cross sections, which are relatively large in spite of their small size, with a smooth liquid surface. Due to the difference in potential in the zone of the nozzle exit area, the liquid is constantly and intensively torn apart and disintegrates into an intense swarm of droplets. Since the retaining force of the surface tension with respect to the supply pressure (determined by the feeding height *h*) is overcome, the liquid is replenished to the extent that it disintegrates into droplets.

For the formation of the droplets or the mist proper, it is actually unnecessary for the medium in the atomizing chamber 16, into which the atomization is to take place, to be in a flowing condition. However, the thus-formed mist must be transported away before it coagulates on the electrode. Therefore, the atomization is effective independently of the intake vacuum or the speed of the engine. The throttle valve must be adjusted so that, depending on the load condition of the engine and the amount being atomized, such an amount of air is taken in that an ignitable, optimally combusting mixture is produced. A governing feature for the amount being atomized is the extent of the difference in potential as well as the area of effective atomizing nozzles available in total. For this reason, possibilities are provided for adjusting the amount of the potential applied to the electrode and for varying the number of effective nozzle groups. With an increase in the potential difference, by the way, one achieves not only an increase in the quantity being atomized but also an increase in the fineness of the droplets. If a maximum potential difference is reached by adjusting the potential, then a further group of nozzles can be added in order to further increase the amount being atomized, by the closing of the switch 44, and the operation can be continued with a smaller difference in potential but with the same quantity being atomized.

Due to the fact that the droplets are produced in an inhomogeneous electrical field, the mist droplets receive an electric charge, the polarity of which is determined by that of the nozzles and the droplets become charge carriers. Due to this charging of the mist droplets, electrostatic forces can cause the mist droplets to travel further and produce a nonuniform packing density in the combustion chamber (layered charge). Because of the mutually homopolar charge, the mist droplets repel one another, and the dange of coagulation is extensively prevented.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Apparatus for the conveyance and atomization of a liquid comprising at least one nozzle means directed toward an atomizing chamber, pressure means for providing a conveying pressure for the liquid, fluid-dynamic means for connecting the at least one nozzle means and the pressure means, electrode means disposed a predetermined distance in front of the at least one nozzle means, at least a portion of the at least one nozzle means being formed of an electrically conductive material and being electrically insulated at least with respect to the electrode means, and means for applying a difference in potential between the electrically conductive portion of the at least one nozzle means and the electrode means during an atomizing period, whereby liquid discharge from the at least one nozzle means is atomized.

2. Apparatus according to claim 1, wherein the electrode means is a flow-permeable electrode.

3. Apparatus according to claim 1, wherein the pressure means includes at least one of a pressure source and a pressure reservoir.

4. Apparatus according to claim 1, wherein the at least one nozzle means is provided with a continuously open discharge outlet and further comprising means for maintaining the conveying pressure at a low value sufficient to overcome the hydraulic resistances between the at least one nozzle means and the pressure means at the largest amounts of liquid to be atomized per unit time and also to enable the surface tension of the liquid effective at the edge of the discharge outlet of the nozzle means to prevent a conveyance of liquid passing through the nozzle means when the nozzle means and the electrode means are maintained at the same potential.

5. Apparatus according to claim 1, wherein the at least one nozzle means is provided with at least one electrically conductive discharge outlet portion constructed narrower with respect to other electrically conductive portions of the at least one nozzle means, the at least one discharge outlet portion projecting in the direction of the electrode means beyond other electrically conductive portions of the at least one nozzle means.

6. Apparatus according to claim 1, wherein the at least one nozzle means is arranged at a location surrounded by the flow of the medium into which the atomization is to take place.

7. Apparatus according to claim 1, further comprising an internal combustion engine, and wherein the liquid is a fuel for the internal combustion engine, and the atomizing chamber includes an intake manifold of the internal combustion engine.

8. Apparatus according to claim 7, wherein the means for applying a difference in potential maintains the difference in potential without interruption during the operating time of the internal combustion engine.

9. Apparatus according to claim 7, wherein the means for applying a difference in potential lowers the difference to zero and increases the value to an operating value in accordance with the operating cycle of the internal combustion engine.

10. Apparatus according to claim 9, wherein the internal combustion engine is a reciprocating piston engine.

11. Apparatus according to claim 1, wherein the means for applying a difference in potential includes means for varying the magnitude of the difference in potential.

12. Apparatus according to claim 1, wherein a plurality of nozzle means is provided.

13. Apparatus according to claim 12, wherein at least a first nozzle means is electrically insulated with respect to the other of the plurality of nozzle means, and selective means for one of electrically connecting the first nozzle means to the electric potential of the other of the plurality of nozzle means and electrically separating the first nozzle means from the other of the plurality of nozzle means independently of the potential difference between the other of the plurality of nozzle means and the electrode means.

14. Apparatus according to claim 13, wherein said selective means includes a switching member.

15. Apparatus according to claim 4, wherein the at least one nozzle means is provided with at least one electrically conductive discharge outlet portion constructed narrower with respect to other electrically conductive portions of the at least one nozzle means, the at least one discharge outlet portion projecting in the direction of the electrode means beyond other electrically conductive portions of the at least one nozzle means.

16. Apparatus according to claim 15, wherein the at least one nozzle means is arranged at a location surrounded by the flow of the medium into which the atomization is to take place.

17. Apparatus according to claim 16, further comprising an internal combustion engine, and wherein the liquid is a fuel for the internal combustion engine, and the atomizing chamber includes an intake manifold of the internal combustion engine.

18. Apparatus according to claim 17, wherein the means for applying a difference in potential maintains the difference in potential without interruption during the operating time of the internal combustion engine.

19. Apparatus according to claim 17, wherein the means for applying a difference in potential lowers the difference to zero and increases the value to an operating value in accordance with the operating cycle of the internal combustion engine.

20. Apparatus according to claim 19, wherein the internal combustion engine is a reciprocating piston engine.

21. Apparatus according to claim 4, wherein the means for applying a difference in potential includes means for varying the magnitude of the difference in potential.

22. Apparatus according to claim 4, wherein a plurality of nozzle means is provided.

23. Apparatus according to claim 22, wherein at least a first nozzle means is electrically insulated with respect to the other of the plurality of nozzle means, and selective means for one of electrically connecting the first nozzle means to the electric potential of the other of the plurality of nozzle means and electrically separating the first nozzle means from the other of the plurality of nozzle means independently of the potential difference between the other of the plurality of nozzle means and the electrode means.

24. Apparatus according to claim 23, wherein said selective means includes a switching member.

25. Apparatus according to claim 15, wherein at least a first nozzle means is electrically insulated with respect to the other of the plurality of nozzle means, and selective means for one of electrically connecting the first nozzle means to the electric potential of the other of the plurality of nozzle means and electrically separating the first nozzle means from the other of the plurality of nozzle means independently of the potential difference between the other of the plurality of nozzle means and the electrode means.

26. Apparatus according to claim 20, wherein the electrode means is a flow-permeable electrode.

27. Apparatus according to claim 25, wherein the electrode means is a flow-permeable electrode.

28. Apparatus for the conveyance and atomization of liquid fuel for internal combustion engines, the apparatus including means providing an outlet cross section directed into a chamber exposed to the flow of intake air and being delimited by an electrically conductive material, pressure means providing a conveying pressure for the liquid, fluid-dynamic conduit means for connecting the outlet cross section means and the pressure means, electrode means arranged at a predetermined distance in front of the outlet cross section means, the outlet cross section means having the boundary edges thereof electrically insulated at least with respect to the electrode means and constructed narrower with respect to other electrically conductive portions of the outlet cross section means, the boundary edges of the outlet cross section means projecting with respect to other electrically conductive portions of the outlet cross section means in the immediate vicinity of the outlet cross section means in a direction toward the electrode means, means for applying a potential difference between the outlet cross section means and the electrode means during the atomizing period whereby liquid fuel discharged from the outlet cross section means is atomized, the outlet cross section means being formed of a plurality of atomizing nozzle means and at least one nozzle means of the plurality of atomizing nozzle means being electrically insulated with respect to the other of the plurality of atomizing nozzle means, and selective means for one of electrically connecting the at least one nozzle means to the electric potential of the other of the plurality of nozzle means and electrically separating the first nozzle means from the other of the plurality of nozzle means independently of the potential difference between the other of the plurality of nozzle means and the electrode means.

29. Apparatus according to claim 28, wherein said selective means includes a switching member.

30. Apparatus according to claim 28, wherein the at least one nozzle means is provided with a continuously open discharge outlet and further comprising means for maintaining the conveying pressure at a low value sufficient to overcome the hydraulic resistances between the at least one nozzle means and the pressure means at the largest amounts of liquid to be atomized per unit time and also to enable the surface tension of the liquid effective at the edge of the discharge outlet of the at least one nozzle means to prevent a conveyance of liquid passing through the at least one nozzle means when the at least one nozzle means and the electrode means are maintained at the same potential.

31. Apparatus according to claim 28, wherein the at least one nozzle means is arranged at a location surrounded by the flow of the medium into which the atomization is to take place.

32. Apparatus according to claim 28, wherein the liquid is a fuel for the internal combustion engine, and the atomizing chamber includes an intake manifold of the internal combustion engine.

33. Apparatus according to claim 28, wherein the means for applying a difference in potential maintains the difference in potential without interruption during the operating time of the internal combustion engine.

34. Apparatus according to claim 28, wherein the electrode means is a flow-permeable electrode.

35. Apparatus according to claim 28, wherein the means for applying a difference in potential lowers the difference to zero and increases the value to an operating value in accordance with the operating cycle of the internal combustion engine.

36. Apparatus according to claim 28, wherein the internal combustion engine is a reciprocating piston engine.

37. Apparatus according to claim 28, wherein the means for applying a difference in potential includes means for varying the magnitude of the difference in potential.

38. Apparatus according to claim 28, wherein said electrode means, arranged at a predetermined distance in front of the outlet cross section means, is disposed within said chamber.

39. Apparatus according to claim 38, wherein said plurality of nozzle means when connected to an electric potential different from that connected to the electrode means serves as another electrode means.

40. Apparatus according to claim 28, wherein said plurality of nozzle means extend into said chamber.

* * * * *